United States Patent [19]

Ohara

[11] 4,205,250

[45] May 27, 1980

[54] ELECTRONIC TUBES

[75] Inventor: Ichiro Ohara, Mobara, Japan

[73] Assignee: Hitachi, Ltd., Tokyo, Japan

[21] Appl. No.: 915,743

[22] Filed: Jun. 15, 1978

[30] Foreign Application Priority Data

Aug. 3, 1977 [JP] Japan ..... 52/92526

[51] Int. Cl.[2] ..... H01J 1/52

[52] U.S. Cl. ..... 313/242; 313/190; 313/207; 313/313; 315/39

[58] Field of Search ..... 315/39; 313/313, 190, 313/204, 205, 207, 242, 243, 241

[56] References Cited

U.S. PATENT DOCUMENTS

| | | | |
|---|---|---|---|
| 2,217,187 | 10/1940 | Smith | 313/190 X |
| 2,310,147 | 2/1943 | Dailey | 313/242 X |
| 3,359,446 | 12/1967 | Murakami et al. | 313/242 |
| 3,728,573 | 4/1973 | Roeber | 313/242 |
| 3,761,759 | 9/1973 | Brunhart et al. | 313/242 |

*Primary Examiner*—Saxfield Chatmon, Jr.
*Attorney, Agent, or Firm*—Charles E. Pfund

[57] ABSTRACT

In an electronic tube comprising a cup shaped first electrode, a cup shaped insulator bonded to the first electrode through a first joint and a second central electrode secured to the insulator through a second joint, there is provided a shielding member intercepting the equipotential magnetic planes of the leakage flux between the first and second joints for preventing thermal fracture of the insulator.

4 Claims, 2 Drawing Figures

ELECTRONIC TUBES

BACKGROUND OF THE INVENTION

This invention relates to an electronic tube, more particularly, an electronic tube which operates under application of electric field and magnetic field.

In an electronic tube of this type, for example, a magnetron or a transmitting tube, an envelope forming a portion of the vacuum vessel is generally constituted by an electrode member on the high voltage side and a stem used to insulate an electrode member on the low voltage side from the high voltage electrode member. Generally, the stem is made of such an insulator as ceramic and is required to have electrical and magnetic insulating properties so as to hold the two electrode members at a definite spacing.

A prior art electronic tube shown in FIG. 1 comprises an inverted cup shaped electrode 1 made of copper, for example, and the lower end of the electrode 1 is soldered to the metallized surface 3*a* coated on the upper end of a cup shaped insulator 3 via a short cylindrical metal member 2 which is made of such a metal as Kovar (trade mark) having a small thermal expansion coefficient, thus forming an envelope. The metal member 2 having a low thermal expansion coefficient acts as a buffer against thermal deformation of the envelope. A rod shaped electrode 4 is disposed in the cup shaped electrode 1 and along the axis of the envelope. The electrode 4 is connected to a terminal 5 extending through the insulator 3. The lower end of the insulator 3 is formed with a metallized surface 3*b* which is brazed to the terminal 5 by means of a brazing metal 6 made of Kovar, for example. A magnetic coil 7 is provided about the cup shaped electrode 1 to generate magnetic field within the electrode 1.

In operation, when electric field and magnetic field are applied, in magnetic point of view, the magnetic flux flows in a direction shown by dotted lines a, and since Kovar utilized to form joints A and B is ferromagnetic, leakage flux tends to flow between the joints as shown by dotted lines b. In electrical point of view, the periphery of the metallized surface 3*a* is generally irregular, so that a large potential gradient will appear at this portion with the result that charged particles such as electrons and ions tend to emit from the joint A into the highly evacuated electronic tube when an intense electric field is applied. When the magnetic field is removed and hence the leakage flux b disappears, the charged particles emitted into the tube would migrate along the electric field shown by solid lines c towards electrode 1. At this time, since the travel of the charged particles is shorter than the means free path of the charged particles in the evacuated tube, there is no chance of collision between the charged particles and the gas molecules remaining in the tube. Accordingly, no ion is multiplied in the tube and glow discharge would not occur.

In the presence of the leakage flux b between joints A and B, however, the charged particles emitted from the joint A spirally moves toward the joint B along the equimagnetic potential planes so that their travel reaches a value that can not be neglected with respect to the mean free path, thus increasing the chance of collision against the molecules of the residual gas. Accordingly, ions are multiplied, thus resulting in glow discharge. Due to heat shock caused by the glow discharge, that is, the collision of the multiplied ions, the insulator 3 would be ruptured.

SUMMARY OF THE INVENTION

Accordingly, it is a principal object of this invention to provide an improved electronic tube capable of preventing thermal rupture of the insulator caused by glow discharge.

According to this invention there is provided an electronic tube of the type comprising a cup shaped first electrode, a cup shaped insulator with its opening opposed the opening of the first electrode through a first joint so as to form an envelope together with the first electrode and a second electrode secured to the insulator through a second joint, the electronic tube operating under electric field and magnetic field impressed across the first and second electrodes, wherein a shielding member is disposed between the first and second joints to intersect equimagnetic potential planes of the leakage flux of the magnetic field between the first and second joints, thereby preventing thermal fracture of the insulator.

DESCRIPTION OF THE PREFERRED EMBODIMENT

Figure 1:
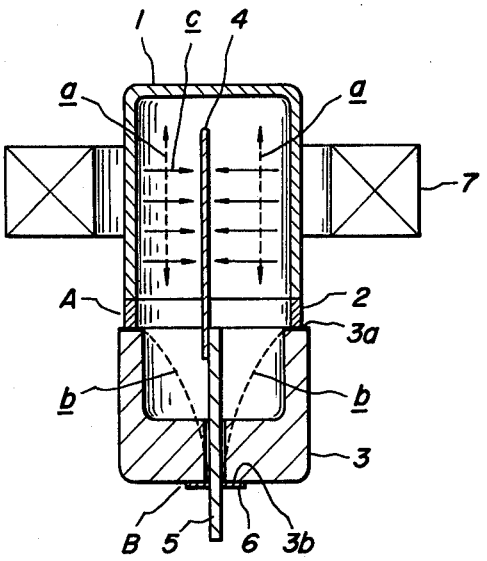
Fig. 1 (PRIOR ART)
FIG. 1 is a diagrammatic longitudinal sectional view showing the construction of one example of a prior art electronic tube.
Figure 2:
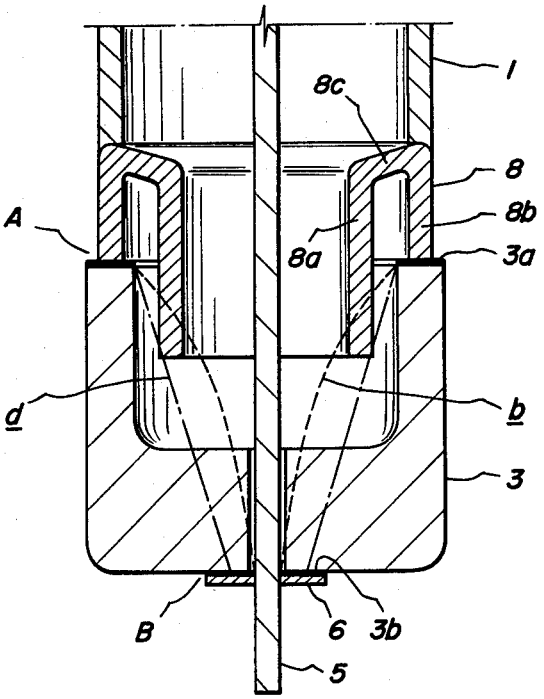
FIG. 2 is a partial longitudinal sectional view showing a portion of an electronic tube embodying the invention.

FIG. 2 which shows the insulator of an electronic tube of this invention, component elements corresponding to those shown in FIG. 1 are designated by the same reference characters. As shown, there is provided a shielding member 8 having an inner cylinder 8*a* intersecting the equimagnetic potential planes of the leakage flux b between the joints A and B. The shielding member 8 comprises an outer cylinder 8*b* corresponding to the prior art metal cylinder 2 shown in FIG. 1, the inner cylinder 8*a* disposed substantially concentrically with the outer cylinder 8*b*, and a yoke 8*c* interconnecting the inner and outer cylinder. The lower end of the outer cylinder 8*b* is soldered to the metallized surface 3*a* whereas the upper end is secured to the lower end of the cup shaped electrode 1. Since the metallized surface 8*b* is maintained at the same potential as the electrode 4, the diameter of the equimagnetic potential plane which intersects the envelope of the locus of the charged particles emitted from the metallized surface gradually decreases towards the joint B, warping inwardly, as shown by dotted curve b. Thus, the curve b defines an inverted, inwardly warping cone about the terminal 5. Consequently, a sufficient shielding effect can be afforded with the inner cylinder 8*a* having the lower end terminating at a plane intersecting chained straight lines d drawn between the joints.

At least the outer cylinder 8*b* of the shielding member 8 should be made of such a metal having a low thermal expansion coefficient as Kovar. All the portions of the shielding member 8 can be made of Kovar. However, since Kovar is expensive, it is advantageous to manufacture only the outer cylinder with Kovar and the manufacture the yoke 8*c* and inner cylinder 8*a* with such a low cost electroconductive material as iron or copper and to suitably bond them to the outer cylinder 8*b*.

With this construction, since the joint A between the metallized surface 3*a* of the insulator 3 and the lower end of the outer cylinder 8*b* of the shielding member 8 is effectively shielded by the inner cylinder 8*a* with respect to the joint B, the charged particles emitted from joint A collide against the inner cylinder 8*a* and are absorbed thereby. Consequently, there is no fear of glow discharge caused by the charged particles as well as the fracture of the insulator 3 caused by heat shock.

Instead of providing the shielding member in front of the joint between the electrode 1 and the insulator 3 as in the foregoing embodiment, such shielding member may be disposed between the terminal 5 and the insulator 3 so as to shield the joint therebetween.

As described above, the electronic tube embodying the invention can prevent glow discharge and the rupture of the insulator thereby improving the quality and reliability of the tube.

What is claimed is:

1. In an electronic tube of the type comprising a cup shaped first electrode, a cup shaped insulator with its opening opposed the opening of said first electrode through a first joint so as to form an envelope together with said first electrode, and a second electrode secured to said insulator through a second joint, said electronic tube operating under electric field and magnetic field impressed across said first and second electrodes, the improvement which comprises a shielding member disposed between said first and second joints so as to intersect equimagnetic potential planes of the leakage flux of said magnetic field between said first and second joints, thereby preventing thermal fracture of said insulator.

2. The electronic tube according to claim 1 wherein said shielding member comprises an outer cylinder, an inner cylinder concentric therewith and a yoke interconnecting said inner and outer cylinders, the outer cylinder forming said first joint to said insulator, and the free end of said inner cylinder extending to straight lines drawn between said first and second joints.

3. The electronic tube according to claim 2 wherein said inner cylinder, said outer cylinder and said yoke are made of a material having a low thermal expansion coefficient.

4. The electronic tube according to claim 2 wherein said outer cylinder is made of a material having a low thermal expansion coefficient and said inner cylinder and said yoke are made of other electroconductive material.

* * * * *

UNITED STATES PATENT AND TRADEMARK OFFICE

CERTIFICATE OF CORRECTION

PATENT NO. : 4,205,250

DATED : May 27, 1980

INVENTOR(S) : Ichiro Ohara

It is certified that error appears in the above-identified patent and that said Letters Patent are hereby corrected as shown below:

Col. 2, line 50, change "8b" to -- 3b -- ;

Signed and Sealed this

*Twenty-third* Day of *September 1980*

[SEAL]

*Attest:*

SIDNEY A. DIAMOND

*Attesting Officer*

*Commissioner of Patents and Trademarks*